US007265726B2

(12) United States Patent
Kenoun et al.

(10) Patent No.: US 7,265,726 B2
(45) Date of Patent: Sep. 4, 2007

(54) MULTI-BAND ANTENNA

(75) Inventors: Robert Kenoun, Palatine, IL (US); Donald L. Cantrell, Jr., Chicago, IL (US)

(73) Assignee: Motorola, Inc., Schaumburg, IL (US)

( * ) Notice: Subject to any disclaimer, the term of this patent is extended or adjusted under 35 U.S.C. 154(b) by 32 days.

(21) Appl. No.: 11/235,283

(22) Filed: Sep. 26, 2005

(65) Prior Publication Data

US 2007/0069954 A1 Mar. 29, 2007

(51) Int. Cl.
*H01Q 21/00* (2006.01)

(52) U.S. Cl. ..... 343/725; 343/700 MS; 343/726; 343/866

(58) Field of Classification Search ..... 343/700 MS, 343/702, 725, 726, 741, 866
See application file for complete search history.

(56) References Cited

U.S. PATENT DOCUMENTS 5,198,826 A * 3/1993 Ito ..... 343/726
6,166,694 A * 12/2000 Ying ..... 343/702
6,466,170 B2 10/2002 Zhou
6,476,769 B1 * 11/2002 Lehtola ..... 343/702
6,618,019 B1 9/2003 Kenoun
6,720,932 B1 4/2004 Flynn et al.
6,856,294 B2 2/2005 Kadambi et al.
2002/0080078 A1 6/2002 Trumbull et al.
2004/0130493 A1 * 7/2004 Horita et al. ..... 343/702
2004/0140938 A1 7/2004 Kadambi et al.
2004/0257291 A1 12/2004 Man et al.
2005/0001769 A1 1/2005 Qi et al.
2006/0170611 A1 * 8/2006 Ko et al. ..... 343/895

* cited by examiner

*Primary Examiner*—Tan Ho
(74) *Attorney, Agent, or Firm*—David S. Noskowicz

(57) ABSTRACT

A multi band antenna system (100) and a wireless communication device are disclosed. The multi band antenna system provides coverage over multiple frequency bands. The multi band antenna system comprises a ground surface, a first conductor (102), a second conductor (104), a common feed conductor (106) coupled to the first conductor and the second conductor, and a ground conductor (108) coupled to the first conductor and the second conductor. The first conductor has a first physical length operationally equal to a half wavelength in a first RF band and operationally equal to a full wavelength in a second RF band. The second conductor has a second physical length operationally equal to a half wavelength in a third RF band.

17 Claims, 5 Drawing Sheets

| FREQUENCY MHz | EFFICIENCY % |
|---|---|
| 824 | 40.88 |
| 840 | 46.80 |
| 860 | 56.79 |
| 880 | 61.56 |
| 894 | 63.32 |

| FREQUENCY MHz | EFFICIENCY % |
|---|---|
| 880 | 62.36 |
| 900 | 60.82 |
| 920 | 54.86 |
| 940 | 52.97 |
| 960 | 43.41 |

| FREQUENCY MHz | EFFICIENCY % |
|---|---|
| 1710 | 54.83 |
| 1740 | 59.76 |
| 1780 | 51.90 |
| 1820 | 47.36 |
| 1850 | 48.13 |

| FREQUENCY MHz | EFFICIENCY % |
|---|---|
| 1850 | 51.54 |
| 1880 | 49.52 |
| 1920 | 53.20 |
| 1960 | 58.47 |
| 1990 | 62.42 |

| FREQUENCY MHz | EFFICIENCY % |
|---|---|
| 2100 | 60.16 |
| 2130 | 63.65 |
| 2150 | 57.72 |
| 2170 | 57.55 |

| FREQUENCY MHz | EFFICIENCY % |
|---|---|
| 1570 | 62.13 |
| 1575 | 66.07 |
| 1580 | 67.07 |
| 2400 | 55.04 |
| 2440 | 47.59 |
| 2484 | 48.71 |

*FIG. 4*

MULTI-BAND ANTENNA

FIELD OF THE INVENTION

This invention relates in general to antennas, and more specifically, to multi-band antenna systems.

BACKGROUND OF THE INVENTION

Multi-band antennas are used in communication devices that operate in a plurality of frequency bands to support operation of multiple communication protocols. Many of these devices now have internal antennas which in contrast to external antennas, are installed within the housing of the devices. The advantages of an internal antenna include reinforcement of shock resistance, reduction of manufacturing costs, an esthetically pleasing form factor etc. Some internal antennas are formed by a plated conductor on a substantially flat circuit board. One challenge faced while designing an internal antenna is the interference with other components and circuits inside the wireless communication device. Another challenge is having enough space on the circuit to place the antenna as many portable communications devices require a small, portable size.

Therefore, the characteristics required for internal antennas designed for these devices include compact size, minimum interference with other components and circuits inside the device, while maintaining the capability to operate with acceptable efficiency in multiple frequency bands.

In multi-band antenna operation, the antenna can be used to operate in more than one frequency band in order to accommodate multiple communications systems or protocols that are designed to operate in a given frequency band. It is desirable to be able to produce wireless communication devices capable of operating according to more than one communication protocol. This may necessitate transmitting and receiving signals in different frequency bands.

Therefore, compact-sized internal antennas, capable of minimizing internal interference while operating in multiple frequency bands, are desirable.

BRIEF DESCRIPTION OF THE DRAWINGS

The present invention is illustrated by way of example and not limitation in the accompanying figures, in which like references indicate similar elements, and in which:

FIG. 4 is a set of tables showing the antenna efficiency of the multi-band antenna system.

Figure 1:
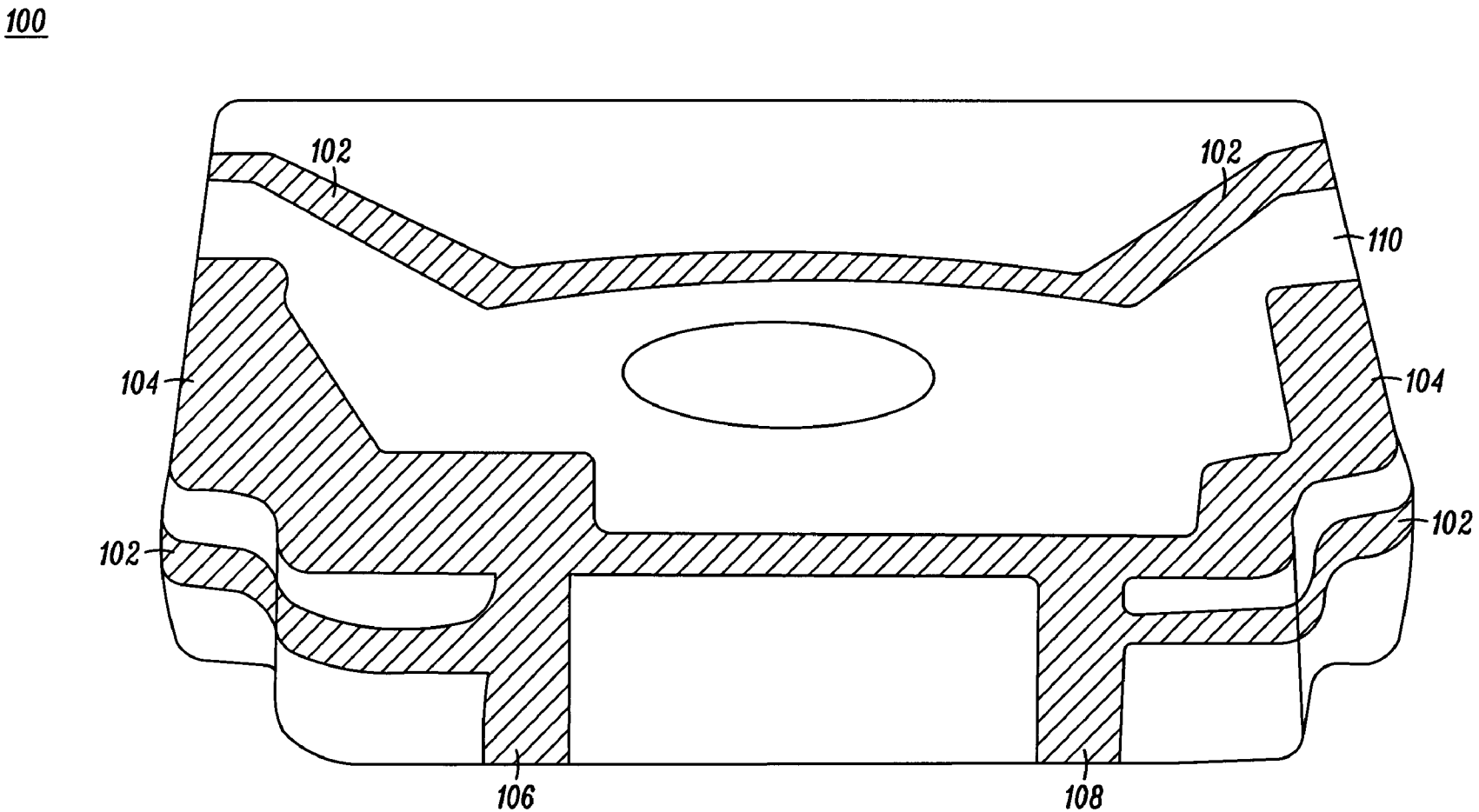
FIG. 1 is an exemplary embodiment of a multi-band antenna system in accordance with the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE INVENTION

Before describing in detail the particular multi-band antenna system and the wireless communication device, in accordance with the present invention, it should be observed that the present invention resides primarily in combinations of apparatus components related to the multi-band antenna system and the wireless communication device. Accordingly, the apparatus components have been represented where appropriate by conventional symbols in the drawings, showing only those specific details that are pertinent to understanding the present invention so as not to obscure the disclosure with details that will be readily apparent to those of ordinary skill in the art having the benefit of the description herein.

In this document, relational terms such as first and second, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

The term "another", as used herein, is defined as at least a second or more. The terms "including" and/or "having", as used herein, are defined as comprising. The term "coupled", as used herein with reference to electrical technology, is defined as connected, although not necessarily directly, and not necessarily mechanically.

FIG. 1 is an illustration of one exemplary embodiment of a multi-band antenna system 100. The multi-band antenna system 100 is used to send and receive signals within a plurality of wireless communication devices, networks or combinations thereof. The multi-band antenna system 100 may be implemented as an internal antenna with broadband characteristics operating in multiple frequency bands. Broadband operation is useful in providing adequate bandwidth to accommodate multiple communication protocols with the one antenna system 100, for example Global System for Mobile Communications (GSM) communication in nominal 800 MHz and nominal 900 MHz bands all the way up to 2400 MHz to include 802.11 and Bluetooth communications for example.

In one exemplary embodiment, the multi-band antenna system 100 is tuned to operate within two general radio frequency ranges which are generally referred to as a low band and a high band. The low band in this exemplary embodiment is below 1000 MHz and the high band is above 1000 MHz. Within the low band and the high band, the multi-band antenna system 100 may operate at multiple frequency sub-bands. In this exemplary embodiment, the multi-band antenna system 100 may be tuned such that the antenna performs as a hepta-band antenna operating over seven frequency bands within both the low band and the high band. The seven frequency bands used in this embodiment, as an example, include AMPS (800 MHz), GSM (900 MHz) which are in the low band, and GPS (1500 MHz), DCS (1800 MHz), PCS (1900 MHz), 3G (2100 MHz), and Bluetooth (2400 MHz) which are in the high band. It is understood by one of ordinary skill in the art that bands may be referred to generally by a rounded off frequency value, or midpoint frequency, and not the specific frequencies which make up the frequency band of operation. For example, the 800 MHz band commonly used for cellular radiotelephone operation is referred to as the 800 MHz band having operating frequencies ranging from 824 MHz to 894 MHz.

It is also understood that the multi-band antenna system 100 may also be tuned to operate in other frequency bands. The multi-band antenna system 100 may also be tuned to operate in fewer frequency bands than the seven bands used in this exemplary embodiment. One of ordinary skill in the art will appreciate the operation and tuning of the antenna elements and frequency bands.

The multi-band antenna system 100 illustrated in FIG. 1 comprises a ground 101 or ground surface, or ground plane or any combination thereof, a first conductor 102 which is spaced from the ground surface in this exemplary embodiment, a second conductor 104 coupled to the first conductor 102, a feed conductor 106, and a ground conductor 108. In this exemplary embodiment, the ground is provided by one layer of a circuit board which in this embodiment is a multi-layer circuit board. The multi-layer circuit board may also support and interconnect various electrical components in the wireless communication device. Examples of such components include a microphone, a camera, a radio frequency (RF) connector, a speaker, and a vibration mechanism. In one embodiment for example, the ground surface 101 includes several inter-connected layers of the multi-layer circuit board.

The multi-band antenna system 100 can be incorporated into a wireless communication device as an internal antenna system. In one embodiment, the multi-band antenna system 100 can be embedded/incorporated in mobile handsets, wireless LAN enabled devices, satellite/GPS devices, personal digital assistants (PDA's), musical devices such as MP3 players having wireless connectivity, computers and so forth.

The first conductor 102 and the second conductor 104 are used for transmission and reception of electromagnetic energy by converting radio waves into electrical signals, and vice versa. The first conductor 102 has a first physical length. In one exemplary embodiment, the first conductor 102 is a loop conductor. The first conductor 102 resonates in the low band and in a first frequency sub band of the high band. The first physical length is at least partially if not substantially equal to a half wavelength of the frequencies (i.e. sub frequency bands) associated with the low band. The first physical length is at least partially if not substantially equal to a full wavelength corresponding to the frequencies (i.e. sub frequency bands) associated with the first frequency sub band.

The low band in this exemplary embodiment includes an 800 MHz band and a 900 MHz band. In this embodiment, for example, the antenna would operate in the 800 MHz cellular band having a frequency range of 824 MHz to 894 MHz and the 900 MHz band having a frequency range from 880 MHZ to 960 MHz.

The first frequency sub band is a portion of the high band. In this exemplary embodiment, the high frequency band includes frequency bands of 1500 MHz, 1800 MHz, 1900 MHz, 2100 MHz, and 2400 MHz. The first conductor 102 may resonate effectively from the 1900 MHz bandwidth to the 2400 MHz bandwidth.

In the exemplary embodiment, shown in FIG. 1, the second conductor 104, is a conductor having a dipole antenna structure. In this illustrated embodiment, the dipole antenna structure is a folded dipole antenna 104 having a first and second bend. The first and second bend allow the second conductor to maintain the second physical length while meeting the other physical constraints such as the size of the first conductor 102 loop antenna structure. The second conductor 104 resonates in a portion of the high band. In this exemplary embodiment, the second conductor 104 resonates at a second frequency sub band of the high band which is substantially not covered by the operating frequency range of the first conductor 102. The second conductor 104 has a second physical length. The second physical length is equal to two quarter wavelengths of at least a portion of frequencies in the high band (i.e. covering the second sub band). A first quarter wavelength portion extending in one direction from the signal source or feed point and a second quarter wavelength extending in the opposite direction from the signal source. In this exemplary embodiment the second conductor 104 resonates in the second frequency sub band that has a bandwidth substantially of 1500 MHz to 1900 MHz bandwidth. As discussed above, the first conductor 102 resonates substantially between 1900 MHz and 2400 MHZ, the first frequency sub band, such that the entire high band is covered by both antennas. The first conductor 102 and the second conductor 104 are also coupled to the same feed point. In one embodiment, the first conductor 102 and the second conductor 104 are capacitively coupled in addition to being coupled to the same feed point.

In the exemplary embodiment shown in FIG. 1, the first conductor 102 and the second conductor 104 are carried on a dielectric support 110. The dielectric support 110 may be a hollow support, formed by a void in the dielectric support thereby spacing the first conductor 102 and the second conductor 104 from the ground surface or the circuit board surface and the ground plane when the ground plane is a layer of the printed circuit board. Examples of materials from which the dielectric support 110 can be made include materials with low dielectric constants, material having low loss tangent, or the like. These materials may include but are not limited to polyimide and polycarbonates and the like. The first and second conductors may also be in the form of wires or conductive material carried on flat surfaces such as the dielectric support. The conductive material may be printed, deposited, sprayed, etched, taped or the like on a circuit board. The dipole may be a metal rod and the loop antenna portion may be a flexible wire loop. The material may take on various forms as understood by one of ordinary skill in the art.

In one exemplary embodiment, the dielectric support 110 is selectively molded with at least two plastic materials. A first plastic material has the capability to be plated with metal conductive material while a second plastic martial will not receive the metal plating material. This allows the metal to be selectively plated on the dielectric support only forming on those areas having the first plastic. The conductor shape is therefore dictated by the conductive plastic shape.

In one exemplary embodiment, the void formed within the dielectric support 110 may be shaped to accommodate other components such as a speaker while maintaining an insignificant drop in performance of the multi-band antenna system 100. Consequently, the multi-band antenna system 100 is accommodated in a manner that is efficient in terms of the use of available space. Small wireless communication devices are in demand, therefore, efficient use of space is beneficial.

The first conductor 102 and the second conductor 104 are coupled to the single feed point or feed conductor 106. In this embodiment, the feed conductor 106 is part of the antenna length. When a feed conductor is present, the feed conductor 106 connects the first conductor 102 and the second conductor 104 to the single feed point. The single feed point is coupled to a single source and the single feed point provides the signal to both the first conductor 102 and the second conductor 104. The single feed point produces a uniform traveling wave of a desired frequency of the radio wave.

The first conductor 102 and the second conductor 104 are also coupled to the grounding conductor 108. In this embodiment, the grounding conductor 108 connects the first conductor 102 and the second conductor 104 to the ground surface 101. As shown in FIG. 1, the feed conductor 106, and the grounding conductor 108 are carried on a portion of the dielectric support 110. The feed conductor 106, and the grounding conductor 108 may be plated on the dielectric support or may be adhesively constrained on the dielectric support 110. The feed conductor 106 and the grounding conductor 108 form electrical connections between the first conductor 102 and the second conductor 104.

The dielectric surface may take various shapes. In one embodiment, shown in FIG. 1-3, the dielectric is a six sided rectangle shape. In this embodiment, the first conductor 102 and the second conductor 104 lie (i.e. are carried) on one or more portions of the dielectric surface 110. The first conductor 102 and the second conductor 104 extend over four surfaces of the dielectric support 110 in the exemplary embodiment illustrated in FIG. 1. In another exemplary embodiment, the first conductor 102 lies on the edges of the dielectric support 110. The shape of the dielectric support 110 may conform to the housing of the device. The shape may conform to the components inside the housing such as the PCB, speakers, microphones, chip components, IC's or the like. The shape may be a function of both the housing and internal constraints.

Figure 2:
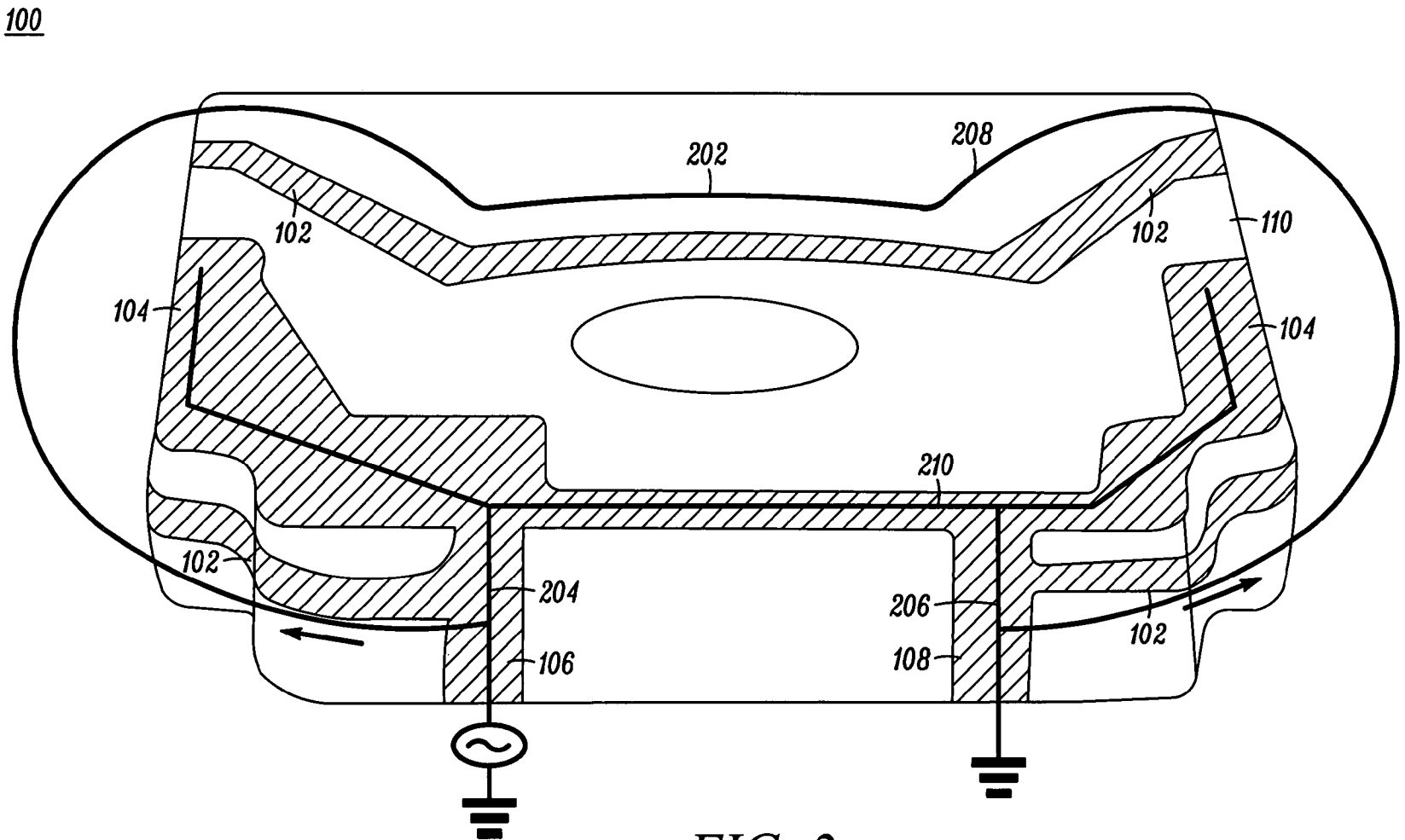
FIG. 2 is an exemplary embodiment of a multi-band antenna system illustrating the conducting elements in the multi-band antenna system when operating in a low frequency band.

FIG. 2 illustrates the multi-band antenna system 100 showing the conductors elements 102, 104 in the multi-band antenna system 100 operating in a low frequency band. FIG. 2 also shows an overlay line drawing of the first conductor 102 and the second conductor 104. A first line overlay 202 shows the basic shape of the first conductor 102 and a second line overlay 210 shows the basic shape of the second conductor 104. Point 208 denotes an open circuit (high impedance) point in the first conductor 102 in the low frequency band. Points 204 and 206 denote the short circuit (low impedance) points in the first conductor 102 which resonates at the low band.

The portions between the short circuit points 204 and 206, and the open circuit point 202 of the first conductor 102, form antenna elements in the multi-band antenna system 100 in the low frequency band. This enables the creation of two antenna elements, each a quarter wavelength in length in the low frequency band. Each antenna element either resonates independently, or increases the total bandwidth of operation of the multi-band antenna system 100, in the low frequency band. Exemplary low frequency bands include the 800 MHz band and the 900 MHz band as discussed above.

Figure 3:
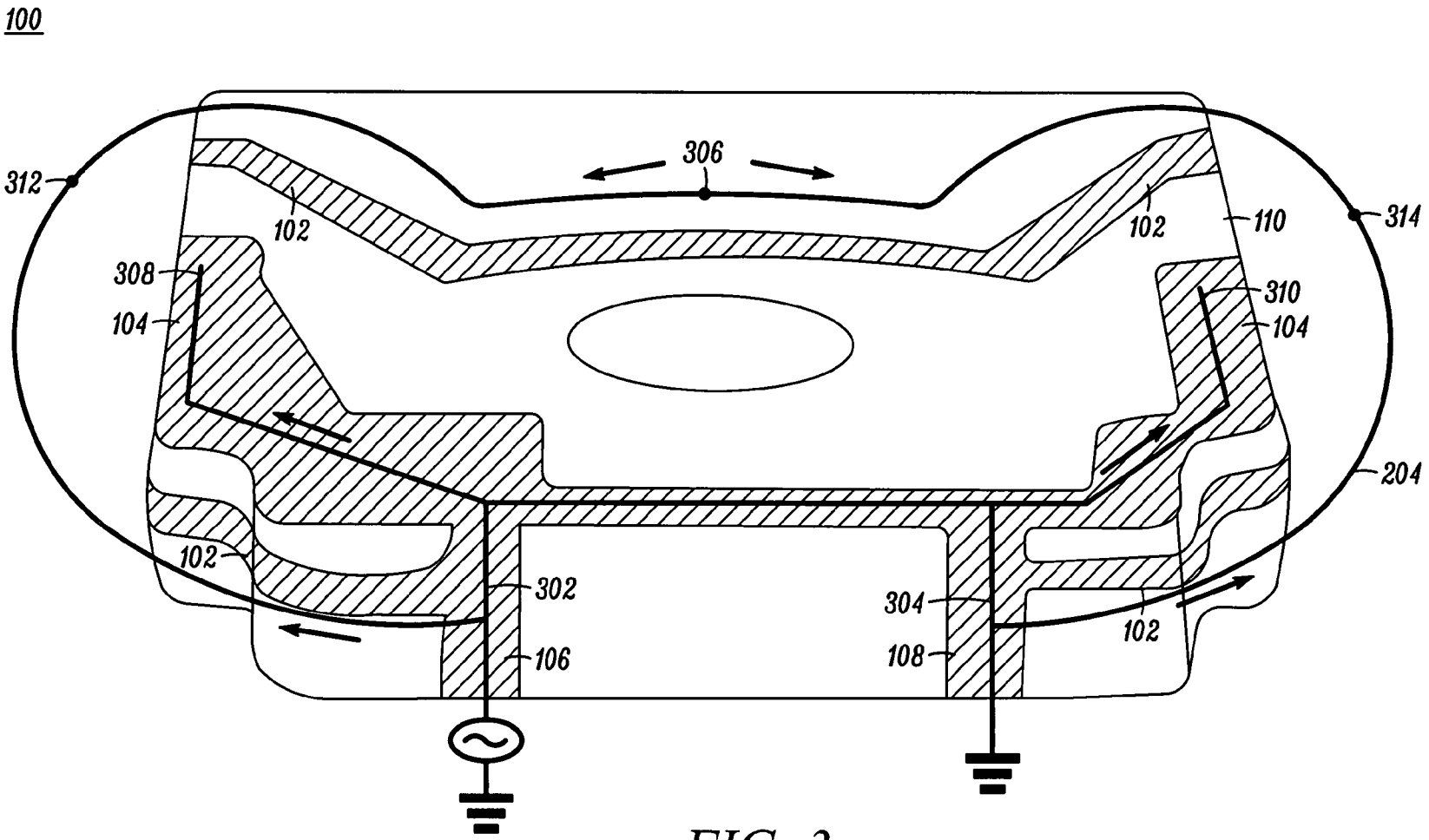
FIG. 3 is an exemplary embodiment of a multi-band antenna system illustrating the conducting elements in the multi-band antenna system when operating in a high frequency band.

FIG. 3 illustrates the multi-band antenna system 100 showing the conductors elements 102, 104 and the corresponding line overlays 208 and 210 however with the antenna operating in a high frequency band. Points 302, 304, and 306 denote short circuit (i.e. low impedance) points in the first conductor 102 and the second conductor 104. Points 308, 310, 312, and 314 denote open circuit (high impedance) points in both the first conductor 102 and the second conductor 104.

The portions between the short circuit points 302, 304, and 306 and the open circuit points 308, 310, 312, and 314 of the first conductor 102, and the second conductor 104, form antenna elements in the multi-band antenna system 100 in the high frequency band.

This allows the creation of six quarter wavelength antenna elements in the high frequency band. For example, amongst the six antenna elements, one antenna element is formed by the portion between the short circuit point 302 and the open circuit point 308. Each antenna element either resonates independently or increases the total bandwidth of operation in the high frequency band.

FIG. 4 is a table 400 showing antenna efficiency of the multi-band antenna system 100 for different frequencies. The antenna efficiency is used to express the ratio of the total radiated power divided by the net power received by the multi-band antenna system 100. The table 400 shows the antenna efficiency at multiple exemplary frequencies bands in which the multi-band antenna system 100 operates. For example, the table shows that the antenna efficiency at 894 MHz is 63.32 percent and at 1575 MHz is 66.07. It is understood that the measurements may vary and that these are exemplary measurements to show the efficiency of the antenna system over the plurality of sub bands in both the high and low bands.

Figure 5:
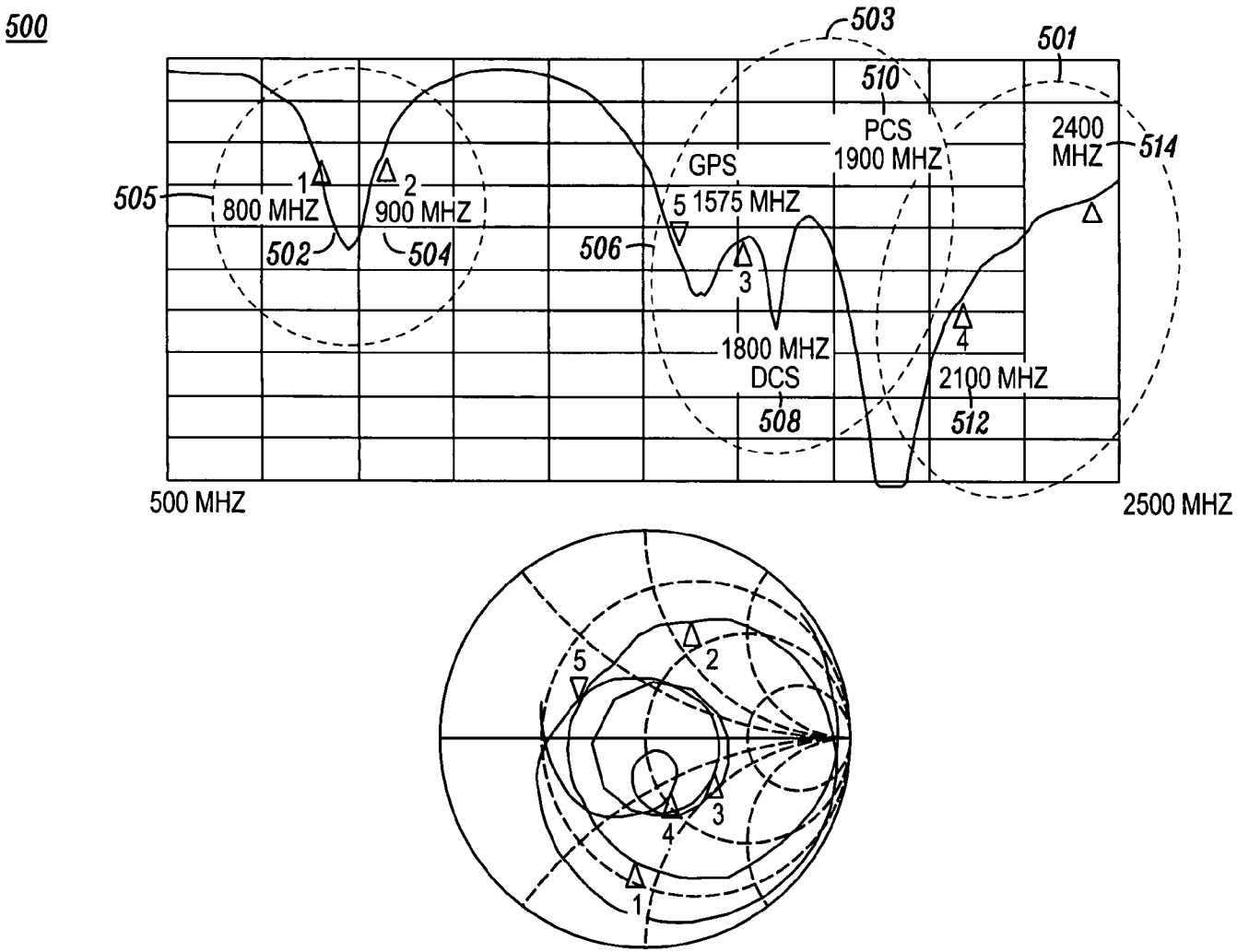
FIG. 5 is an exemplary return-loss plot for the multi-band antenna system.

In conjunction with FIG. 4, FIG. 5 is an exemplary return loss plot showing seven RF bands of operation for the multi-band antenna system 100. The return loss plot 500 exemplifies which bands the multi-band antenna operates in and which conductor (i.e. the first conductor 102 or the second conductor 104) operates in the respective RF band. In this embodiment, a first RF band 502 of operation and second RF band 504 of operation are in the low band. Also shown in this embodiment, are a third 506, a fourth 508, a fifth 510, a sixth 512, and a seventh band 514 of operation which are in the high band.

The first conductor 102 resonates in the first sub band of the high band, indicated by circle 501, which includes a portion of the 1900 MHZ band 510 of operation, the 2100 MHz band 512 of operation and the 2400 MHz band 514 of operation. The second conductor 104 resonates in a second sub band of the high band, indicated by circle 503, which includes the 1500 MHz band 506 of operation, the 1800 MHz band 508 of operation and a portion of the 1900 MHz band 510 of operation. The first conductor also resonates in the low band, indicated by circle 505, which includes the 800 MHZ band 502 of operation and the 900 MHZ band 504 of operation. The bands of operation may also be referred to as sub bands of the first and second sub band.

The multi-band antenna system, described in various embodiments of the present invention is a compact internal antenna system that can be embedded in a wireless communication device. In the embodiments shown, the antenna system may be built on a ground plane having a length no longer than 100 mm. The multi-band antenna system exhibits broadband capabilities that allow operation on several frequency bands, such as AMPS, GSM, GPS, DCS, PCS, 3G and Bluetooth.

In the foregoing specification, the invention and its benefits and advantages have been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. A multi band antenna system comprising:

a ground;

a dielectric support carrying the first conductor, the second conductor, and the common feed conductor;

a first conductor coupled to the ground, the first conductor having a first physical length operationally equal to a half wavelength in a first RF band and operationally equal to a full wavelength in a second RF band, wherein the first conductor is carried on four surfaces of the dielectric support;

a second conductor coupled to the first conductor and coupled to the ground, the second conductor having a second physical length operationally equal to a half wavelength in a third RF band; and a common feed conductor coupled to the first conductor and the second conductor.

2. The multi band antenna system of claim 1, wherein the first conductor is a loop conductor.

3. The multi band antenna system of claim 2, wherein the second conductor is a dipole conductor.

4. The multi band antenna system of claim 3, wherein the loop conductor encompasses the dipole conductor.

5. The multi band antenna system of claim 1, wherein the second conductor is a dipole conductor.

6. The multi band antenna system of claim 1, wherein the first conductor and the second conductor are capacitively coupled.

7. The multi band antenna system of claim 1, wherein the first band is a low band and wherein the second RF band and the third RF band are in a high band.

8. The multi band antenna system of claim 7, wherein the low band is substantially between and including 800 MHz and 900 MHz.

9. The multi band antenna system of claim 8, wherein the high band is substantially between and including 1500 MHz and 2500 MHz.

10. The multi band antenna system of claim 7, wherein the first RF band is between and including 824 MHz and 960 MHz.

11. The multi band antenna system of claim 7, wherein the second RF band is substantially between and including 1500 MHz and 1900 MHz.

12. The multi band antenna system of claim 7, wherein the third RF band is substantially between and including 1900 MHz and 2500 MHz.

13. The multi band antenna system of claim 1, wherein the dielectric support has a cavity.

14. A multi band antenna system comprising:

a ground surface;

a dielectric support having at least a first side and a second side;

a first conductor spaced from the ground surface having a first wavelength at a first frequency band and a second wavelength at a second frequency band, at least a portion of the first conductor is carried on the first side of the dielectric support and the second side of the dielectric support;

a second conductor coupled to the first conductor having a third wavelength at the second frequency band;

a feed conductor coupled to the first conductor and the second conductor; and a ground conductor coupled to the first conductor and the second conductor.

15. The multi band antenna system of claim 14, wherein the multi band antenna system is a hepta-band antenna.

16. The multi band antenna system of claim 14, wherein the multi band antenna system comprising a dielectric support supporting the first conductor, the second conductor, the common feed conductor and the common ground conductor on the ground surface.

17. The multi band antenna system of claim 16, wherein the first conductor lies on the edge of the dielectric support.

* * * * *